US005107923A

United States Patent [19]

Sherman et al.

[11] Patent Number: 5,107,923

[45] Date of Patent: Apr. 28, 1992

[54] FLOW DISTRIBUTION DEVICE

[75] Inventors: Robert Sherman, West Hartford, Conn.; Fred Roberts, Agawam, Mass.; Robert G. Urie, Windsor, Conn.

[73] Assignee: United Technologies Corporation, Hartford, Conn.

[21] Appl. No.: 712,373

[22] Filed: Jun. 10, 1991

[51] Int. Cl.[5] ..... F28F 13/06

[52] U.S. Cl. ..... 165/159; 165/174

[58] Field of Search ..... 165/159, 174

[56] References Cited

U.S. PATENT DOCUMENTS

| | | | |
|---|---|---|---|
| 709,051 | 9/1902 | Schneller | 165/174 |
| 1,344,351 | 6/1920 | Norelius et al. | 165/174 X |
| 1,358,050 | 11/1920 | Audianne | 165/174 |
| 1,673,409 | 6/1928 | Kelley | 165/174 |
| 1,802,930 | 4/1931 | Seelert | 165/174 X |
| 2,313,052 | 3/1943 | Dean | 165/159 X |
| 2,602,647 | 7/1952 | Miller | 165/174 |
| 3,351,131 | 11/1967 | Berthold | 165/159 |
| 4,256,174 | 3/1981 | Yoshida | 165/159 X |
| 4,287,945 | 9/1981 | Hessari | 165/174 |
| 4,289,198 | 9/1981 | Young | 165/159 |
| 4,857,144 | 8/1989 | Casparian | 159/13.2 |

*Primary Examiner*—Allen J. Flanigan

[57] ABSTRACT

A heat exchanger (18) located in an enlarged flow area section (10) of a duct (12) includes a plate (14) located downstream of the exchanger for improving distribution of the duct flow.

8 Claims, 1 Drawing Sheet

FLOW DISTRIBUTION DEVICE

DESCRIPTION

1. Technical Field

The present invention relates to fluid flow distribution devices and more particularly to fluid flow distribution devices which include distribution plates.

2. Background Art

Many applications employ cross flow heat exchangers to transfer heat from one fluid to another. The rate at which the heat is transferred between the fluids depends on a number of factors such as the difference between the inlet fluid temperatures, the fluid flow rates, the properties of the fluids, and the efficiency of the heat exchanger. These factors, in conjunction with the heat transfer requirements, influence the geometric sizing of the heat exchanger. In addition, the geometric dimensions of the fluid duct in which the heat exchanger rests also influence the sizing of the heat exchanger. In a cramped application, for example, the inlet duct cross-sectional area may be small relative to the cross-sectional area of the heat exchanger's inlet surface. The inlet duct exit may also be located relatively closely to the inlet surface of the heat exchanger. As a result, the transition area between the inlet duct exit and the heat exchanger is insufficient to disperse the fluid uniformly through the heat exchanger. Consequently, heat exchanger performance drops.

Prior art solutions to the drop in performance include changing the inlet fluid temperatures and the flow rates of the fluids. Some applications, however, operate in a small range of performance. In turbine engines, for example, fluid temperatures and flow rates must be maintained within narrow confines to protect the integrity of interrelated systems. Moreover, gross changes in fluid flow rates may require an increase in internal power consumption and therefore an overall net loss in power output.

Distribution plates positioned upstream of the heat exchanger have, in prior art, been a successful means of increasing heat exchanger performance. Typically, plates are conical in shape and contain apertures which increase in diameter as the radial distance from the apex of the cone increases. When the flow meets the distribution plate, it is directed radially outward along the face of the plate and consequently encounters the increasingly larger area apertures. A more uniform dispersion of fluid results within the enlarged duct area as greater amounts of flow pass through the radially outward apertures of the plate. The enhanced dispersion of the fluid, in turn, increases the performance of the heat exchanger.

Prior art distribution plates have also included simple flat plates containing apertures. While not as efficient as the conical embodiment, the flat plate configuration still improves the distribution of the flow through the heat exchanger. Either of these solutions, however, is limited to a position upstream of the heat exchanger.

DISCLOSURE OF THE INVENTION

Objects of the present invention include the provision of a fluid flow distribution device comprising a fluid flow distribution plate designed to be positioned downstream of a heat exchanger which improves the flow distribution through the heat exchanger.

According to one aspect of the present invention, a solid distribution plate is provided downstream of a heat exchanger. Possible geometric configurations of the distribution plate include a partial spherically shaped plate as well as a simple conical plate or a flat plate. The desired concentration and positioning of the flow through the heat exchanger, as well as the performance sought, determine the shape of the distribution plate.

Placing a solid distribution plate aft of the heat exchanger changes the fluid pressure distribution profile normally associated with a heat exchanger acting alone. Consider a heat exchanger having a uniform entrance face exposed to a constant volumetric rate of fluid flow. The fluid flow through the heat exchanger will experience a constant impedance across the face of the heat exchanger as a result of the uniform design of the heat exchanger. For this reason, no impetus exists for the flow to travel in any path other than that taken from the inlet duct. Similarly, a uniform independent heat exchanger exposed to a small cross-sectional area of flow, provides little differences in impedance between the area experiencing the flow and that which is not. The impetus for the flow to disperse into a more uniform distribution profile prior to passing through the heat exchanger, therefore, is slight.

The present invention provides a distribution plate positioned downstream of the heat exchanger which causes a significant increase in local pressure in an area upstream of the plate. If the plate is centered with respect to the inlet fluid stream, for example, undispersed flow in line with the inlet stream will still enter the heat exchanger, but will experience an increase in flow resistance. The increased flow resistance results from the flow already through the heat exchanger having to change its flow path when it meets the distribution plate. The geometry and proximity of the downstream distribution plate determine how drastically the downstream flow path will change and consequently how much pressure in front of the heat exchanger is built up. As a result, when the inlet flow encounters the higher pressure region upstream of the heat exchanger caused by the distribution plate, the flow disperses laterally to the lower pressure peripheral regions. The percentage of flow dispersed peripherally is directly related to the geometry and positioning of the distribution plate.

BEST MODE FOR CARRYING OUT THE INVENTION

Figure 1:
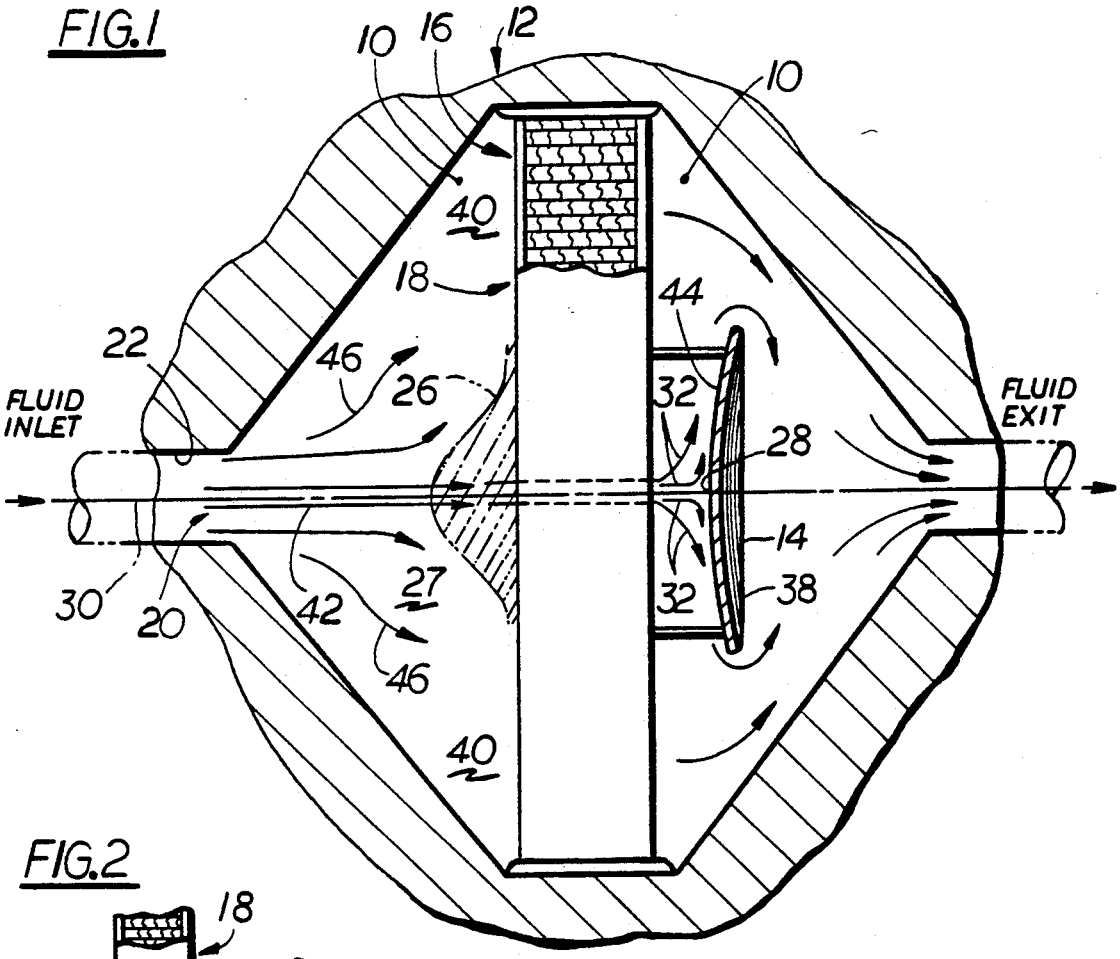
FIG. 1 is a sectional view of an enlarged duct containing a cross flow heat exchanger with a distribution plate positioned downstream of heat exchanger, with its apex disposed in-line with the centerline of the inlet duct.

Now referring to FIG. 1, an enlarged section 10 of fluid duct 12 is provided with a distribution plate 14 located downstream of the inlet face 16 of a cross-flow heat exchanger 18. A first fluid flow 20 enters the enlarged section 10 of the duct 12 through an inlet duct 22. The inlet duct 22 cross-sectional area is small relative to the cross-sectional area of the inlet face 16 of the heat exchanger 18. In a steady-state condition, flow 20 exiting the inlet duct 22 confronts a region 26 of increased fluid pressure developed upstream 27 of the heat exchanger 18 as a result of the geometry and positioning of the distribution plate 14.

Figure 4:
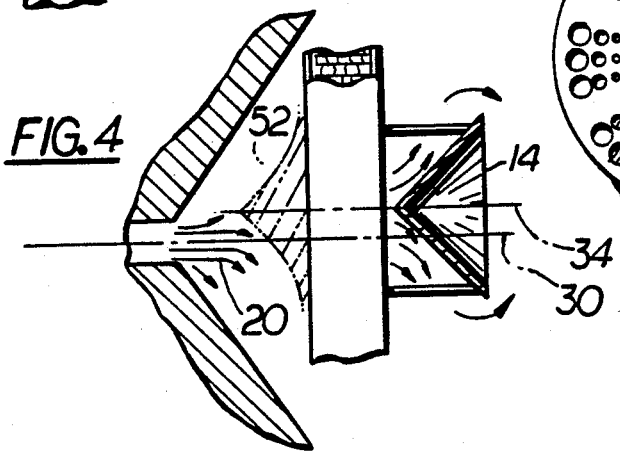
FIG. 4 is a sectional view of an enlarged duct containing a cross flow heat exchanger with a distribution plate positioned downstream of the heat exchanger, with its apex offset from the centerline of the inlet duct.

If the distribution plate 14, for example, is a partial spherical shape 38, having its apex 28 in line with the centerline 30 of the inlet duct 22, flow 20 exiting the inlet duct 22 parallel to the centerline 30 of the inlet duct 22 will encounter a region 26 of increased fluid pressure resulting from the distribution plate's 14 effect on the fluid flow downstream 32 of the heat exchanger 18. Similarly, the in line positioning of the plate 14 and the inlet duct 22 dictates the in line positioning of the increased pressure region 26. The increased pressure zone 26 could be relocated, for instance, by offsetting the centerlines 30, 34 of the distribution plate 14 relative to the inlet duct 22 as shown in FIG. 4. An offset increased pressure region 52 and consequent offset flow profile might be used in an application where the second fluid of the cross-flow heat exchanger 18 passes through the opposite passages of the heat exchanger 18 asymmetrically. The offset flow profile would direct the first fluid flow 20 through the area of the heat exchanger 18 that would optimize heat exchange between the first fluid flow and the second fluid.

Figure 2:
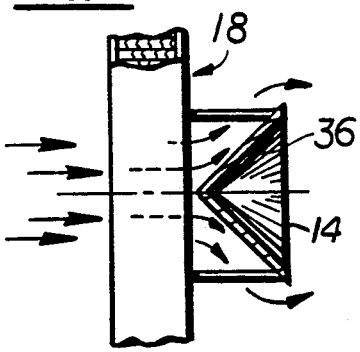
FIG. 2 is a sectional view of an enlarged duct containing a cross flow heat exchanger with a conical shaped distribution plate positioned downstream of a heat exchanger.

As shown in FIG. 2, if a conical shaped distribution plate 36 were implemented instead of the semi-hemispherical plate 38, (shown in FIG. 1) the flow resistance presented by the plate 36 would change according to the new geometry. Specifically, the lateral profile of the increased pressure zone 26 in front of the heat exchanger 18 would resemble the cone-shaped plate 36. The profile would assume a sharper, more angular geometry in comparison with the curved slope geometry associated with the partial spherical shaped distribution plate 38.

When the fluid flow 20 meets the increased pressure zone 26, a portion of the flow diverts to the lower pressure peripheral areas 40. The geometry and positioning of the distribution plate 14 determines what percentage of the flow 20 diverts from the high pressure area 26. The central flow 42 through the increased pressure zone 26 area meets the plate 14 and diverts across the face 44 of the plate 14 and ultimately around. Similarly, lateral flow 46 through the duct section 10 at increasing distances away from the high pressure mass 26 area meets the distribution plate 14 and diverts around. This lateral flow 46, however, meets increasingly less resistance as the distance away from the high pressure mass 26 area increases.

Figure 3:
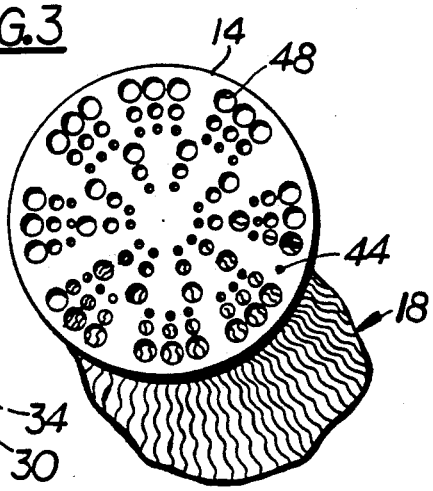
FIG. 3 is a distribution plate with an arrangement of perforations.

Referring now to FIG. 3, the distribution plate 14 may also include perforations 48 which indirectly aid in the distribution of fluid flow 20 through the heat exchanger 18. Varying the size and position of the perforations 48 across the face 44 of the distribution plate 14 permits adjustability of the fluid flow 20 across the face 44 of the distribution plate 14. The fluid flow 20, in turn, effects the profile of the increased pressure region 26 upstream of the heat exchanger 18. Likewise, the profile of the increased pressure region 26 effects the fluid flow 20 distribution through the heat exchanger 18. A more precisely defined flow distribution may therefore be created by using the perforations 48 in conjunction with the plate's 18 geometry.

We claim:

1. A fluid flow distribution device, disposed downstream of a heat exchanger located in an enlarged section of a fluid duct, for laterally distributing fluid entering the enlarged section of the fluid duct from an inlet duct of smaller cross-sectional area than the enlarged section of the fluid duct, comprising:

a distribution plate having a streamwise aligned centerline, said distribution plate shaped to define a surface having an increased lateral displacement relative to the centerline with increased downstream displacement, and wherein said distribution plate includes a plurality of perforations.

2. A fluid flow distribution device, disposed downstream of a heat exchanger located in an enlarged section of a fluid duct, for laterally distributing fluid entering the enlarged section of the fluid duct from an inlet of smaller cross-sectional area than the enlarged section of the fluid duct, comprising:

a partial spherical distribution plate positioned with the apex thereof pointing towards the downstream surface of the heat exchanger, wherein the centerline of said distribution plate is disposed along the centerline of the smaller cross-sectional area inlet duct, and wherein distribution plate includes a plurality of perforations.

3. A fluid flow distribution device, disposed downstream of a heat exchanger located in an enlarged section of a fluid duct, for laterally distributing fluid entering the enlarged section of the fluid duct from an inlet duct of smaller cross-sectional area than the enlarged section of the fluid duct, includes:

a conical shaped distribution plate positioned with the apex thereof pointing towards the downstream surface of the heat exchanger, wherein the centerline of said distribution plate is disposed along the centerline of the smaller cross-sectional area inlet duct.

4. A fluid flow distribution device according to claim 2, wherein said distribution plate includes a plurality of perforations.

5. A fluid flow distribution device, disposed downstream of a heat exchanger located in an enlarged section of a fluid duct, for laterally distributing fluid entering the enlarged section of the fluid duct from an inlet duct of smaller cross-sectional area than the enlarged section of the fluid duct, includes:

a partial spherical shaped distribution plate positioned with the apex thereof pointing towards the downstream surface of the heat exchanger, wherein the centerline of said distribution plate is disposed offset of the centerline of the smaller cross-sectional area inlet duct.

6. A fluid flow distribution device according to claim 3, wherein said distribution plate includes a plurality of perforations.

7. A fluid flow distribution device, disposed downstream of a heat exchanger located in a enlarged section of a fluid duct, for laterally distributing fluid entering the enlarged section of the fluid duct from an inlet duct of smaller cross-sectional area than the enlarged section of fluid duct, includes:

a conical shaped distribution plate positioned with its apex pointing towards the downstream surface of the heat exchanger, wherein the centerline of said distribution plate is disposed offset of the centerline of the smaller cross-sectional area inlet duct.

8. A fluid flow distribution device according to claim 5, wherein said distribution plate includes a plurality of perforations.

* * * * *